US006026728A

United States Patent [19]

Gühring et al.

[11] Patent Number: 6,026,728

[45] Date of Patent: Feb. 22, 2000

[54] FIREARM WITH BLANK CARTRIDGE DEVICE

[75] Inventors: Manfred Gühring; Hermann Albrecht, both of Oberndorf, Germany

[73] Assignee: Heckler & Koch GmbH, Oberndorf/Neckar, Germany

[21] Appl. No.: 09/111,910

[22] Filed: Jul. 8, 1998

[30] Foreign Application Priority Data

Jul. 8, 1997 [DE] Germany ..... 197 29 565

[51] Int. Cl.[7] ..... F41A 21/26

[52] U.S. Cl. ..... 89/14.5; 89/14.2

[58] Field of Search ..... 89/14.5, 14.2; 42/77, 79

[56] References Cited

U.S. PATENT DOCUMENTS

| | | | |
|---|---|---|---|
| 606,115 | 6/1898 | Benet | 89/14.5 |
| 3,732,776 | 5/1973 | Snodgrass | 89/14.5 |
| 3,744,370 | 7/1973 | Snodgrass | 89/14.5 |
| 3,766,822 | 10/1973 | Sophinos | 89/14.5 |
| 5,325,758 | 7/1994 | Compton et al. | 89/14.5 |

FOREIGN PATENT DOCUMENTS

| | | | |
|---|---|---|---|
| 1578381 | 12/1970 | Germany | 89/14.5 |
| 381569 | 10/1964 | Switzerland . | |

*Primary Examiner*—Stephen M. Johnson
*Attorney, Agent, or Firm*—Marshall, O'Toole, Gerstein, Murray & Borun

[57] ABSTRACT

A blank cartridge device is disclosed for use with a firearm having a flash reducer. The blank cartridge device includes a bushing defining a bore sized to receive the flash reducer. It also includes a block mounted within the busing bore and defining a blind hole disposed in substantial alignment with the barrel bore. In addition, the blank cartridge device includes a compression spring disposed within the bushing bore such that movement of the bushing from the released position to the locked position compresses the spring.

25 Claims, 3 Drawing Sheets

FIREARM WITH BLANK CARTRIDGE DEVICE

FIELD OF THE INVENTION

The invention relates generally to firearms, and, more particularly, to a blank cartridge device for use with a firearm having a flash reducer.

BACKGROUND OF THE INVENTION

Throughout this document, positional designations such as "front", "across" or the like, are defined as follows. "Front" always points in the direction of shooting. "Lengthwise" always runs parallel to the axis of the bore. "Top" is referenced to a weapon in a normal horizontal firing position.

A blank cartridge device for use with a firearm having a flash reducer is known from U.S. Pat. No. 3,744,370 and has since proven itself. Indeed, blank cartridge devices constructed pursuant to the teachings of the present invention preferably employ the features of the device disclosed in U.S. Pat. No. 3,744,370 pertaining to gas buildup and trapping of shells and particles. Accordingly, U.S. Pat. No. 3,744,370 is hereby incorporated by reference in its entirety.

In addition to U.S. Pat. No. 3,744,370, the following publications relate to blank cartridge devices: U.S. Pat. No. 3,766,822, U.S. Pat. No. 3,732,776 and CH Patent 381,569.

Flash reducers are often attached to known firearms such as automatic weapons via outside threading on the front end of their barrels. A typical known flash reducer consist of a sleeve having inside threading on the rear end by which the flash reducer can be firmly screwed onto the outside threading of an automatic weapon or the like. A cylindrical bore section is connected to the inside threading. The diameter of the inside bore is only slightly larger than the largest diameter of the barrel bore. The purpose of this cylindrical bore section to the protect the muzzle of the barrel from damage, which could otherwise result, for example, from improper cleaning. A nozzle-like bore section that enlarges toward the front end of the flash reducer is connected to the cylindrical section. The side wall of the nozzle section is perforated by radial openings that are generally designed as longitudinal slits. The front peripheral edge of the nozzle section has two notches opposite each other in the transverse direction. A screwdriver-like tool can be attached to these notches in order to either screw the flash reducer onto the barrel or to unscrew it from the barrel. The flash reducer can also have flattenings on its outside for attachment of a screwdriver.

As mentioned above, blank cartridge devices are known in the art. One such known blank cartridge device has an essentially cylindrical block with a central blind hole into which a sleeve is inserted. The blind hole is open to the rear and has an inside diameter which is much smaller than that of the barrel. The block has at least one spiral groove on the front part of its outside periphery. This spiral groove is connected to the blind hole by at least one transverse hole. The block is welded into a bushing, so that the spiral groove is covered from the outside.

If a blank cartridge is fired by a firearm with the above described blank cartridge device mounted, the propellant gases that form are forced to flow through the sleeve, into the blind hole, and then, through the covered, narrow spiral groove. This forcing of the propellant gases through the spiral groove significantly increases the pressure in the barrel, thereby causing the gas pressure or recoil pulse required to reload the firearm to build up within the firearm. Any foreign objects that are released when the blank cartridge is fired (for example, splinters of a wooden projectile or particles of a burst plastic cartridge), and which reach the spiral groove, are placed into eddy-like motion by the spiral groove such that, after leaving the spiral groove, they are carried outward, reduced in size, with a high centrifugal force component and are trapped by the forward protruding bushing.

If, on the other hand, a live cartridge is inadvertently loaded into the firearm, it will be braked in the sleeve and, if necessary, trapped by the bottom of the blind hole. In such a case, the propellant gases are relieved through the spiral groove. The barrel withstands the briefly developed overpressure undamaged, as does the mount on the muzzle. Only the blank cartridge device is damaged, and it must be replaced.

Unexpected problems develop in the above-described blank cartridge device. For example, in order to use the above-described blank cartridge device, the flash reducer must be removed from the firearm and the blank cartridge device mounted in its place. In order for the flash reducer not to loosen despite firing, its inside threading must be forcefully tightened onto the outside threading of the barrel. To unscrew the flash reducer before use of the blank cartridge device and to subsequently screw it back on, tools of the aforementioned type are furnished to the armorer of the troops who issues the firearm. In practice, the armorer will typically not pass along these tools to the troops in order to save themselves the effort of administrative work in case of loss.

At any rate, before each new weapon is issued, its flash reducer is typically loosened and only slightly tightened by hand.

In the case of a fixed flash reducer, the troops will sometimes loosen the flash reducer by inserting a bayonet or another available tool through the radial slit in the side wall of the flash reducer. Such an approach runs the risk of damaging the flash reducer. Moreover, loosely screwed-on flash reducers significantly influence shooting accuracy and can also be lost. This problem can be eliminated by a corresponding regulation, which, for example, assigns an inspector to bring along tools of the mentioned type and to ensure their proper use when weapons are issued and returned before and after use of blank cartridge devices.

Some of these problems are partially solved by the blank cartridge device disclosed in U.S. Pat. No. 3,744,370. That blank cartridge device can be pushed over the flash reducer and attached to either the barrel or the flash reducer. Therefore, when the blank cartridge device is mounted, the flash reducer remains in its position on the barrel. As a result, the flash reducer does not need to be removed by the troops during normal use of the weapons. The blank cartridge device is mounted and removed from the weapon as needed.

Advantages are gained by this approach. For example, because the flash reducer need never be removed from the barrel, it permanently protects the muzzle. In addition, because the flash reducer can remain on the muzzle at all times, the flash reducer can optionally be screwed on or shrunken on by heat, so that it cannot be loosened by simple means. It is even possible to weld the flash reducer to the barrel or to produce the flash reducer in one piece with the barrel. The most favorable procedure can, therefore, be chosen for the flash reducer and its attachment, since it no longer has to be unscrewed by the troops.

SUMMARY OF THE INVENTION

In accordance with an aspect of the invention, a blank cartridge device is provided for use with a firearm having a flash reducer. The firearm typically includes a barrel having a front end and defining a barrel bore, and the flash reducer typically defines a cylindrical bore disposed adjacent the front end of the barrel and an expanding bore in communication with the cylindrical bore. The flash reducer will also typically include a gas outlet opening in a wall defining the expanding bore. The blank cartridge device is provided with a bushing defining a bushing bore sized to receive the flash reducer. The bushing is longitudinally movable with respect to the flash reducer between a released position and a locked position. The blank cartridge device also includes a block mounted within the bushing bore and having an end connector defining a blind hole disposed in substantial alignment with the barrel bore. In addition, the blank cartridge device includes a compression spring disposed within the bushing bore such that movement of the bushing from the released position to the locked position compresses the spring. The spring is sized to locate the bushing in the released position when the spring is uncompressed.

In some embodiments, when the bushing is in the released position, propellant gases exiting the barrel bore are exhausted through the gas outlet opening in the expanded bore of the flash reducer; the bushing defines a passage for exhausting the gas passing through the gas outlet opening; and/or the bushing provides a visual indication that it is unsecured with respect to the firearm when the bushing is in the released position.

In some embodiments, the compression spring is mounted around the end connector of the block; and/or the compression spring is mounted for compression between the block and the flash reducer. In any of the foregoing embodiments, a stop ring may be disposed between the compression spring and a surface of the flash reducer.

In some embodiments, the blind hole is narrowed with respect to the barrel bore.

In some embodiments, the block has an outer surface which cooperates with the bushing to define a non-linear gas outlet channel, and the gas outlet channel communicates with the blind hole via an exhaust channel. The non-linear channel may be substantially coil shaped.

In some embodiments, the end connector is located within the cylindrical bore of the flash reducer when the bushing is in the locked position. In some such embodiments, a seal is mounted on the end connector where it will preferably be disposed in sealing engagement with the cylindrical bore of the flash reducer when the bushing is in the locked position. In some such embodiments, the seal comprises at least one sealing ring.

In some embodiments, the blank cartridge device is further provided with a locking device mounted on the bushing. In such embodiments, the locking device is preferably adapted to engage behind a surface of the flash reducer to secure the bushing to the flash reducer when the bushing is in the locked position. In some such embodiments, the locking device comprises a non-radial, transversely running blocking element. In some such embodiments, the bushing defines a transverse groove, and the blocking element is mounted within the groove for movement between a secured position and an unsecured position. In some embodiments, the blocking element includes an extension that protrudes from the bushing unless the blocking element is in the secured position. In any of the foregoing embodiments, the blocking element may comprise: a detent having a first end and a second end, wherein the first end of the detent is pivotally mounted within the transverse groove and the second end of the detent is adapted to mate with a mating portion of the bushing when the blocking element is in the secured position. It may also comprise a detent spring biasing the detent towards the mating portion of the bushing to ensure securement thereto when the blocking element is in the secured position.

In some embodiments, the bushing defines a first plug aperture, the block defines a second plug aperture, and the blank cartridge device includes a plug sized to be simultaneously disposed within the first and the second plug apertures to locate the block with respect to the bushing. In some such embodiments, the first and second plug apertures are open ended such that the plug can be pushed completely therethrough to permit removal of the block from the bushing.

In some embodiments, the blind hole includes a narrowed section which is located adjacent the expanding bore of the flash reducer when the bushing is disposed in the locked position such that, when a live round is discharged into the blind opening, the narrowed section deforms without damaging the flash reducer.

In accordance with another aspect of the invention, a blank cartridge device for use with a firearm having a flash reducer is provided. The blank cartridge device includes a bushing defining a bushing bore sized to receive the flash reducer. The bushing is longitudinally movable with respect to the flash reducer between a released position and a locked position and defines a transverse groove. The blank cartridge device is further provided with a block mounted within the bushing bore and including an end connector defining a blind hole disposed in substantial alignment with the barrel bore. In addition, the blank cartridge device includes a non-radial blocking element mounted within the transverse groove for movement between a secured position and a non-secured position. The blocking element is positioned to engage a surface of the flash reducer to secure the bushing to the flash reducer when the bushing is in the locked position and the blocking element is in the secured position.

Other features and advantages are inherent in the apparatus claimed and disclosed or will become apparent to those skilled in the art from the following detailed description and its accompanying drawings.

DESCRIPTION OF THE PREFERRED EMBODIMENT

The same reference numbers are used throughout the following discussion and in the appended drawings to refer to the same parts or elements.

Figure 1:
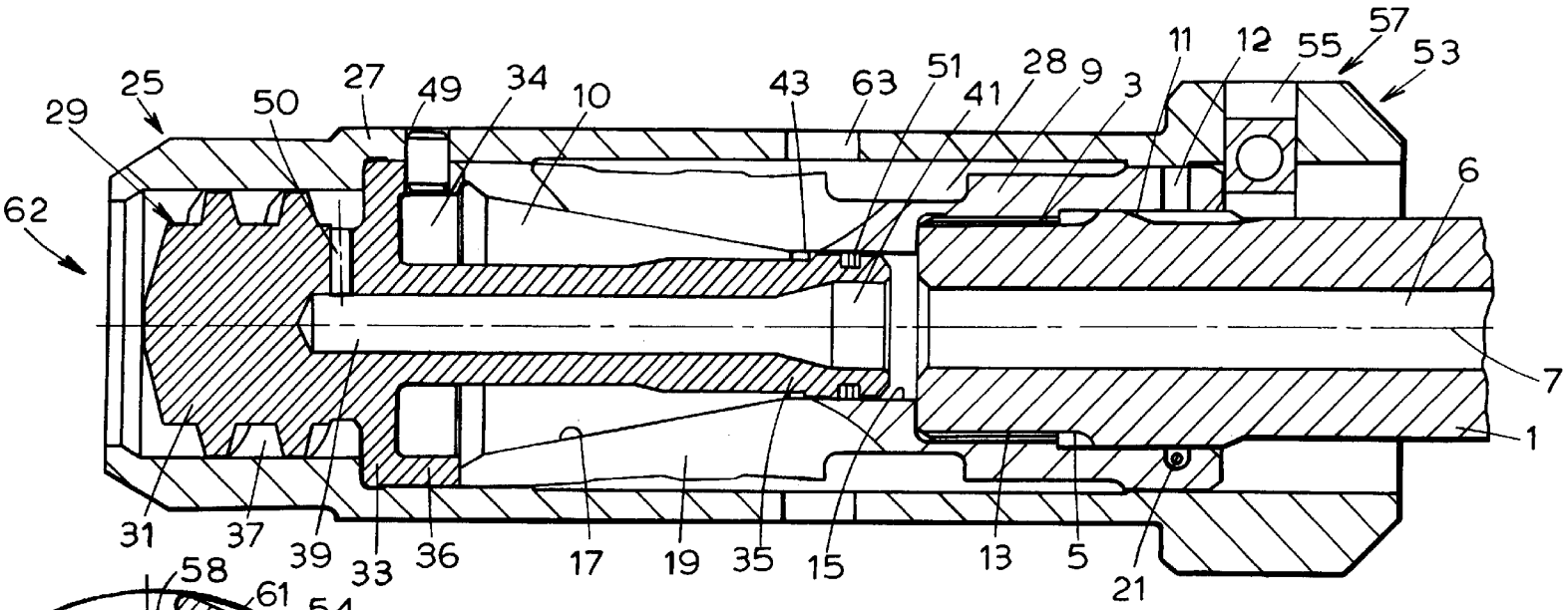
FIG. 1 is an enlarged, longitudinal cross-sectional view of a blank cartridge device constructed in accordance with the teachings of the invention and mounted upon a firearm carrying a flash reducer.

A blank cartridge device 25 constructed in accordance with the teachings of the invention is illustrated in FIG. 1 in an exemplary environment of use, namely, on the muzzle of the barrel 1 of an automatic weapon. In the illustration, the muzzle of the barrel 1 include outside threading 3, behind which a protruding collar 5 is formed. A flash reducer 9 is secured to the muzzle via the threading 3. As is conventional, the barrel 1 defines a barrel bore 6. A bore axis 7 forms the center axis of the barrel 1, of the flash reducer 9, and of the blank cartridge device 25.

In the illustrated embodiment, the flash reducer 9 defines a central bore 10, whose individual sections named in succession from back to front are: a centering bore 11, which is mounted centered on the collar 5 of the barrel 1; an internal threaded section 13, which is screwed onto outside threading 3; a coaxial, cylindrical bore 15, whose diameter is greater than that of the barrel bore 6; and an expanding or widening bore 17 that begins with a cylindrical section, whose diameter is greater than that of the coaxial, cylindrical bore 15 and grades into an expanding section that widens sharply in conical fashion forward.

In the illustrated embodiment, the wall of the flash reducer 9 is perforated in the region of the expanding bore 17 by six longitudinal slits 19. The longitudinal slits 19 are designed to cause dispersion of the propellant gases leaving the muzzle of the barrel 1. In the illustrated embodiment, a recess 12 is formed in the top of the collar 5 of the barrel 1. A safety clamp 21 can be mounted in this recess 12 near the rear end of the flash reducer 9 to prevent inadvertent loosening of the flash reducer 9.

Two notches (not shown), are formed opposite each other in the front peripheral edge of flash reducer 9. These notches are sized to cooperate with a wrench to facilitate mounting and removing the flash reducer 9 from the barrel 1. The blank cartridge device 25 has an external, tubular bushing 27. The bushing 27 preferably has a substantially cylindrical outside contour and internally defines a bushing bore 28. The rear part of the bushing bore 28 is formed to be pushed over and to receive the flash reducer 9.

The front fifth of the inside bushing bore 28 of bushing 27 has a slightly smaller diameter than the remainder of the bore and grades into a shoulder. The front end of the inside bore 28 is somewhat reduced in diameter with respect to the remainder of the front fifth of the bore 28. A block 29, having a head 31, a shoulder 33 and an end connector 35, is fitted into the inside bore 28. The head 31 has an essentially cylindrical outside contour and fits into the frontmost fifth of the inside bore 28 of bushing 27. The head 31 ends just before the reduced front end of the bore 28. A double-threaded trapezoidal thread is cut into the peripheral surface of the head 31 to form a groove. This groove is covered on its outward side by the inside wall of the bushing 27, so that a coil-shaped channel 37 is formed between the outer periphery of the head 31 and the inside surface of the bushing 27.

The shoulder 33 of the block 29 is cup-like in shape and defines a center recess 34 open to the rear. The center recess 34 is surrounded by a peripheral sleeve 36. This peripheral sleeve 36 fits within the portion of the inside bushing bore 28 with the larger diameter. Shoulder 33 sits against an abutment formed between the front fifth and the back four fifths of the bushing bore 28. The block 29 is secured in bushing 27 by a pressed-in pin 49. The pressed-in pin 49 simultaneously extends through an aperture defined in the peripheral sleeve of shoulder 33 and an aperture defined in the wall of bushing 27. Preferably, the apertures are both open-ended such that the pressed-in pin 49 can be pushed at least partially into the recess 34 to release the block 29 from the bushing 28 to facilitate repair or replacement of the block 29.

An end connector 35 extends rearwardly from the center of the bottom of the recess 34. The end connector 35 is perforated in the center by a blind hole 39, which ends in the front in head 31. Just before reaching its end, the blind hole 39 is connected through a transverse hole 50 to the rear end of the coil-like channel 37. Starting from the front, the blind hole 39 discharges into an initial section 41 having an enlarged diameter. This enlarged section 41, in turn, discharges at the rearmost end of the end connector 35 opposite the bore 6 of the barrel 1 (See FIG. 1). The diameter of the initial section 41 is slightly larger than the inside diameter of the barrel bore 6. The diameter of the blind hole 39 is much smaller than the diameter of the barrel bore 6. A conical transition extends between the initial section 41 and the narrowed section of the blind hole 39. The conical transition lies in the region of the rear end of the expanding bore 17 when the blank cartridge device 25 is mounted in the locked position (FIG. 1).

Close to its rear end, the outside diameter of the end connector 35 is enlarged and forms a forward facing stop 43. In the embodiment illustrated in FIGS. 3 and 4, a stop ring 45 abuts the front of the stop 43. The embodiments shown in FIGS. 3 and 4 also include a compression spring 47 that surrounds the end connector 35 and forces the stop ring 45 to the rear against stop 43. The spring 47 is mounted between the stop ring 45 and the bottom of the cup-like shoulder 33. The compression spring 47 and the stop ring 45 of the device shown in FIGS. 3 and 4 are excluded from the device of FIG. 1.

An annular groove is formed in the covered end of end connector 35. Three sealing rings 51 are positioned next to each other, similarly to piston rings, in the annular groove. As is apparent from FIG. 1, the rear end of end connector 35 sits precisely in the coaxial, cylindrical bore 15 and, with the assistance of the sealing rings 51, is sealed against the inner wall of bore 15 when the blank cartridge device 25 is mounted in the locked position. The opening of the initial section 41 of the blind hole 39 then lies opposite to, and a short distance from, the muzzle of the barrel 1.

Figure 2:
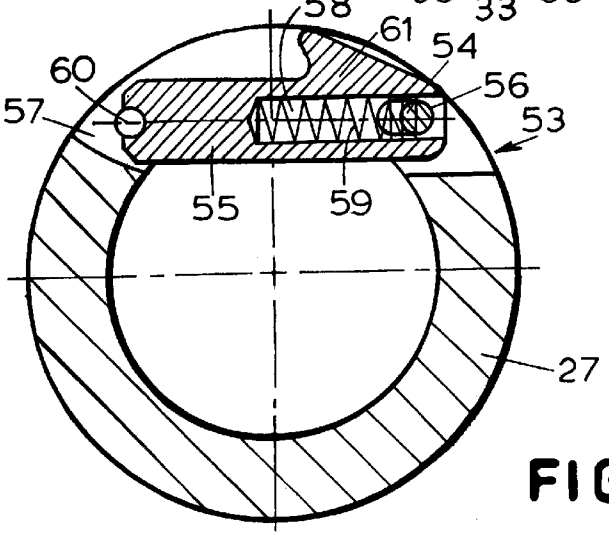
FIG. 2 is a cross-sectional view of the bushing and locking device of the blank cartridge device shown in FIG. 1.
Figure 3:
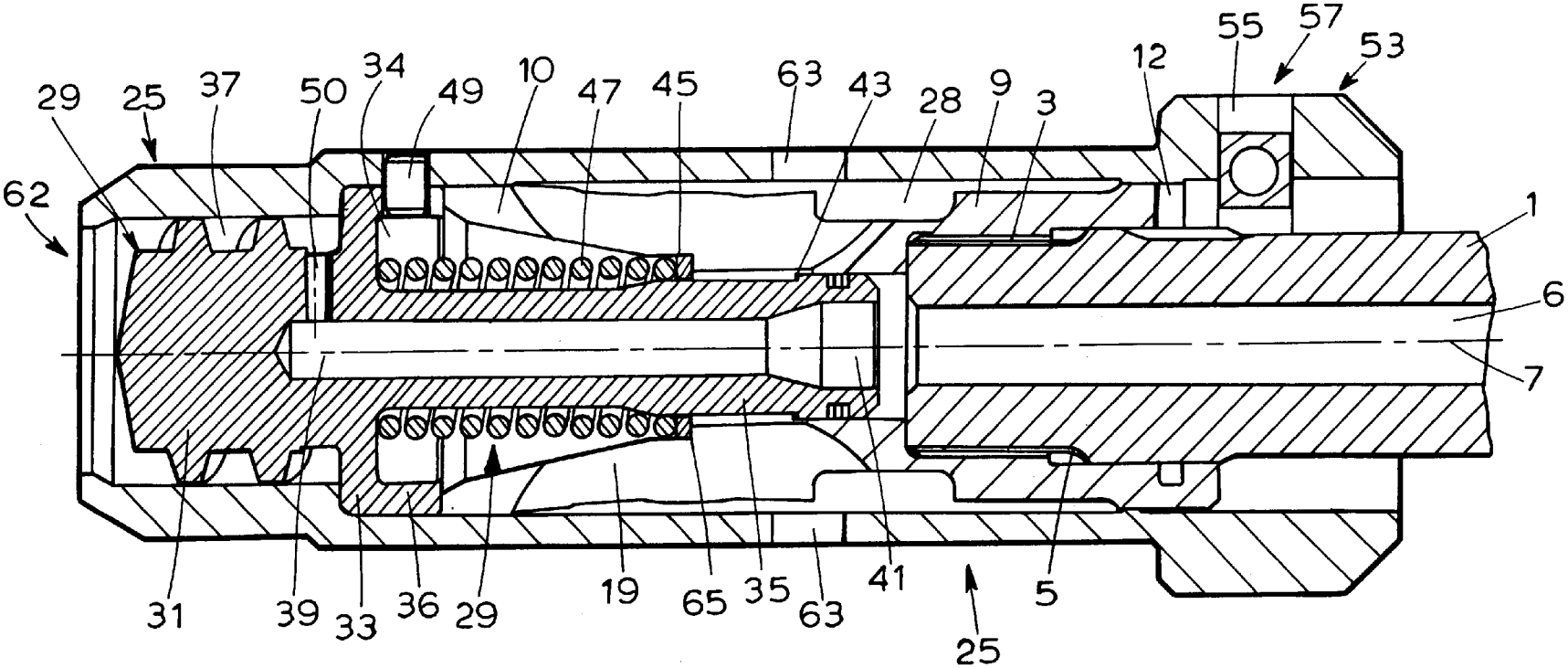
FIG. 3 is an enlarged, longitudinal cross-sectional view of a second blank cartridge device constructed in accordance with the teachings of the invention and mounted in the locked position upon a firearm carrying a flash reducer.
Figure 4:
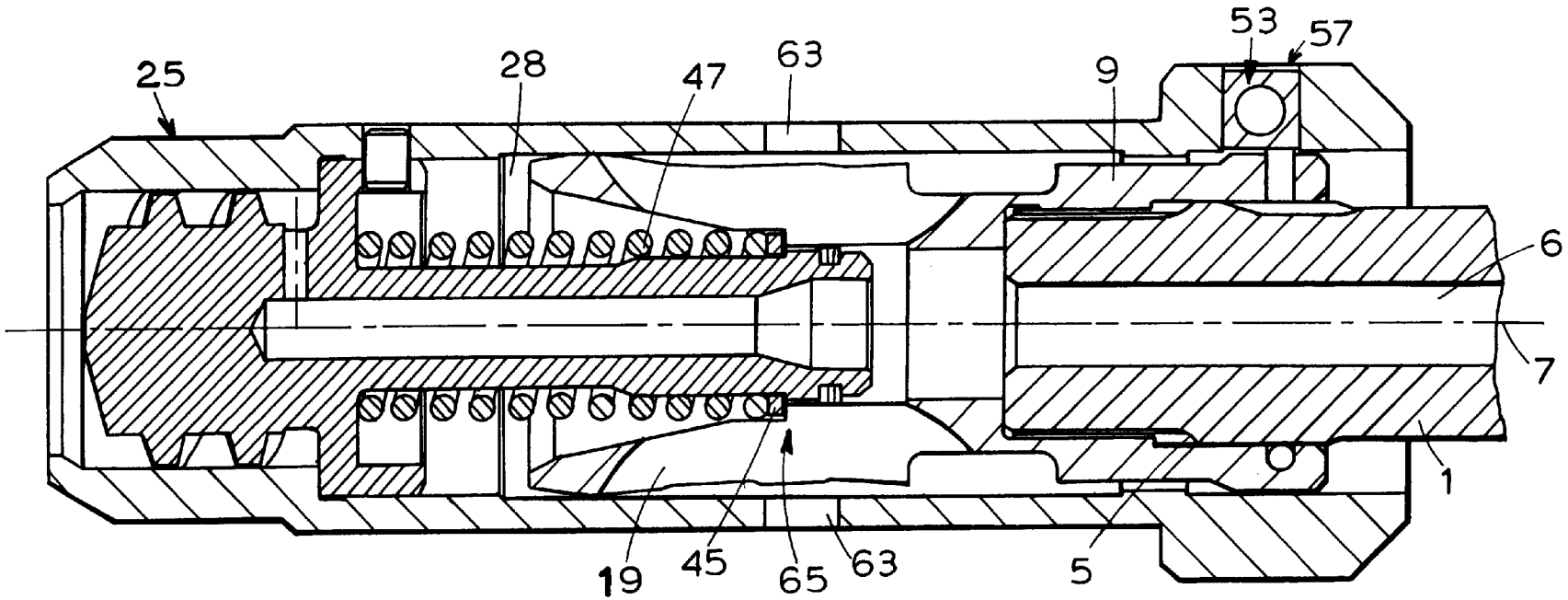
FIG. 4 is a view similar to FIG. 3 but illustrating the blank cartridge device in the released position.

When the blank cartridge device 25 shown in FIGS. 3 and 4 is mounted on the flash reducer 9, the end connector 35 is first introduced into the expanding bore 17 until the stop ring 45 abuts against a projection 65 formed on the flash reducer 9 (FIG. 4). The blank cartridge device 25 can then only be pushed farther by overcoming the resistance of the increasingly compressed compression spring 47. If one releases the blank cartridge device 25 prior to locking and with the compression spring 47 compressed, the spring 47 immediately forces the device 25 forward into the released position shown in FIG. 4. Only when a locking device 53 (see FIG. 2) secures the blank cartridge device 25 in its locked position (see FIG. 3), does the blank cartridge device 25 remain in the position depicted in FIG. 3.

As shown in FIG. 1, the bushing 28 defines a transverse groove 57. The locking device 53 includes a blocking element implemented in the illustrated embodiments by a transversely running detent 55. The detent 55 defines an elongated hole 54. This elongated hole 54 slidably receives a longitudinal pin 56 located rear an end of the traverse groove. The hole 54 is located at the end of the detent 55 such that the detent 55 is mounted for pivoting motion between a secured position and an unsecured position. As shown in FIG. 2, the detent 55 includes a bore 58 within which a detent spring 59 is mounted. The spring 59 is disposed between an end of the bore 58 and the pin 56. The detent spring 59 forces the detent 55 away from the longitudinal pin such that the pin 56 is biased towards one end of hole 54. A second longitudinal pin 60 is arranged near the other end of the transverse groove. The free end of the detent 55 has a notch designed complementary to the contour of the second longitudinal pin 60. When the notch of the detent 55 matingly engages the second pin 60, the detent 55 is secured against pivoting movements about the first pin 56. When the detent 55 is so secured, it is in its secured position. Otherwise, it is in an unsecured position.

As shown in FIG. 2, the detent 55 has a handle 61 on its top, whose tip precisely enters the transverse groove 57 when the detent 55 is locked in it secured position, so that the top is flush with the periphery of the bushing 27.

When the blank cartridge device 25 is moved longitudinally over the flash reducer 9, the detent 55 is folded so far upward that it exposes the inside contour of bushing 27 via the transverse groove 57. The blank cartridge device 25 is forced backward against the force of compression spring 47, until the shoulder 33 abuts the front end edge of the flash reducer 9 (see FIG. 4). The handle 61 of the detent 55 is then pushed downward with, for example, the thumb, such that the detent 55 is pivoted downward into the longitudinal groove 57. The detent 55 then enters the longitudinal groove 57, until the handle 61 slides out from beneath the thumb and is pressed fully into the transverse groove 57. The notch on the free end of the detent 55 then locks onto the second longitudinal pin 60. The detent 55 can only be released by applying a compression force suitable to overcome the detent spring 59 such that the pin 56 slides with respect to the hole 54 and the notch is released from the second pin 60. The detent 55 engages behind the rear end of the flash reducer 9. The force of the compression spring 47 also presses the detent 55 against this rear end of flash reducer 9. As a result, the detent 55 is additionally secured by friction in its secured position.

To remove the blank cartridge device 25, force is briefly applied against the front of the device while the detent 55 is simultaneously pushed in the longitudinal direction, for example, with a nail against handle 61. The detent spring 59 is thus compressed, and the notch on the free end of the detent 55 is moved away from the second longitudinal pin 60. Upon application of a suitable off-center force, the detent 55 will pivot upward and out of the groove 57. The blank cartridge device 25 is then free to move forward under the force of the compression spring 47.

When blank cartridges are fired, the propellant gases enter the blind hole 39 and pass through the transverse hole 50 into the coil-like channel 37. The gases pass through the channel 37, leave at its front end, and then emerge through the open end of the bushing 27. Any particles that were entrained in the gas stream will also reach the coil-like channel 37 and will pass through it at such a high speed that, after leaving the channel 37, they are pressed against the inside surface of the bushing 27 by centrifugal force, where they are then braked before they exit through its narrowed opening 62. Due to the high flow resistance of the outflow path defined by the blind hole 39, the transverse hole 50 and the coil-like channel 37, gas buildup occurs. The gas pressure in the barrel 1 rises to a level such that the automatic weapon can execute all loading functions free of disturbance.

If a live cartridge is inadvertently fired when the blank cartridge device 25 is mounted in it secured position, the shot reaches the blind hole 39 unhampered through the initial section 41 of the end connector 35 (i.e., the diameter of the initial section 41 is much smaller than that of the shot). The shot is, thus, deformed and braked in the blind hole 39. The front part of the end connector 35 is deformed by this braking action. The rear part of the block 29 with the thickened end 31 remains undeformed. The shot material collects on the bottom of the blind hole 39, whereas the gases can escape through the transverse hole 50 behind the shot material.

The detent 55 is subjected to a shearing force when the live shot is braked. It is, however, constructed to withstand the increased load occurring when a live cartridge is fired. As a result, the locking device 53 will operate after a live shot is braked and the (damaged) blank cartridge device 25 can be removed from the flash reducer 9 by releasing the detent 55 from the groove 57 as explained above. A repair might even be possible, since the bushing 27 could remain undamaged and the damaged block 29 can be removed by knocking out the pin 49.

As shown in FIGS. 1, 3 and 4, the bushing 27 defines passages 63 for exhausting gas. If the blank cartridge device 25 is not locked and assumes the unsecured position shown in FIG. 4, and if a blank cartridge is then fired, the propellant gases escape through the longitudinal slits 19 of the flash reducer 9 and the passages 63 in the bushing 27 of blank cartridge device 25.

Instead of employing a removable block 29 in the device 25, persons of ordinary skill in the art will appreciate that it is possible, and might even be advantageous, to make the blank cartridge device 25 from a single piece with a hole open to the rear that can be pushed over the flash reducer. For example, the block 29 could optionally be welded into the bushing 28. However, it is preferable to attach the block 29 to the bushing 29 by means of the pressed-in transverse pin 49 discussed above to avoid the possibility of heat distortion during production. Heat distortion could pose problems in the fitting surfaces of the blank cartridge device 25. Thus, it is advantageous to eliminate heat distortion. It is preferable that the block 29 be attached in the front region of the bushing 27, whose rear region can be easily pushed over the flash reducer.

Persons of ordinary skill in the art will appreciate that the disclosed, blank cartridge devices 25 are advantageous in many respects. For example, the bushing 27 can be produced as a simple piece equipped with a through hole, whose rear section is designed to fit the outside diameter of the flash reducer. While, in principle, it would be conceivable to construct the blank cartridge device 25 like an empty can which is pushed from the front onto the flash reducer 9, since a high gas pressure from the barrel 1 acts upon the blank cartridge device 25, it is preferable that the block 29 be lengthened rearward through the bushing 27 by an end connector 35.

As explained above, the end connection 35 is penetrated by a blind hole 39 and fits into the coaxial, cylindrical hole 15 of the flash reducer 9 when the blank cartridge device 25 is mounted. Due to this arrangement, the impact surface for the gas pressure exiting the barrel bore 6 is only slightly larger than the cross-sectional surface of the barrel, so that the force required to fasten the device 25 onto the muzzle is minimized. This is of particular significance when a live cartridge is inadvertently fired with the blank cartridge device 25 mounted, because, in addition to the firing energy acting on the device, a particularly high gas pressure is generated by the live shot.

To further adapt the device 25 for braking of a live shot, the transition between the end section 41 and the narrowed section of the blind hole 39 lies within the expanding bore 17 of the flash reducer 9 when the blank cartridge device 25 is mounted. If a live shot enters the narrowed section of the blind hole 39, both the narrowed section of the blind hole 39 and the end connector 35 are widened. The shape change work performed by the live shot reduces the impact of the shot against the bottom of the blind hole 39. Since the narrowed section of the blind hole 39 is disposed adjacent the expanding bore of the flash reducer 9, widening distortion of the end connector causes little or no stress on the flash reducer 9. The flash reducer 9 is, thus, not affected by the widening of the end connector 35. Therefor, after removal of the damaged blank cartridge device 25, the weapon itself, together with the flash reducer 9, remains undamaged.

Persons or ordinary skill in the art will appreciate that blank cartridge devices 25 constructed in accordance with the teachings of the invention can optionally be fastened on the flash reducer 9 by a threaded connection. If the barrel 1 is sufficiently thick, such blank cartridge devices 25 can surround the flash reducer 9 and optionally engage in threading on the barrel 1. With the latter approach, it is then generally immediately obvious when the blank cartridge device has not been screwed on far enough. However, as explained above, it is preferable to attach the blank cartridge device 25 by means of a locking device 53 that engages, for example, behind a protrusion of the flash reducer 9, so that the blank cartridge device 25 can be mounted with a single movement.

To ensure reliable seating on the flash reducer 9, some embodiments locate a longitudinally movable stop ring 45 on the outside of the end connector 35. When mounting the blank cartridge device 25 on the firearm, the stop ring 45 is forced rearward against a stop on the flash reducer 9 by a pressure spring 47 supported on the block 31. The stop ring 45 has an outside diameter such that, during positioning of the blank cartridge device 25 on the flash reducer 9, the stop ring 45 runs against the wall of the expanding bore and compresses the compression spring 47 as the bushing 27 is moved further rearward.

During positioning, the blank cartridge device 25 must be pressed onto the flash reducer 9 with sufficient force to overcome the force of the compression spring until the mount engages and secures the blank cartridge device 25 in its locked position. If the pressure is removed before the device 25 is locked on the firearm, the compression spring 47 pushes the blank cartridge device 25 forward again, where its position visually indicates beyond a doubt that no attachment has occurred.

Although as explained above, some embodiments exclude the compression spring 47, the embodiments employing the compression spring are advantageous because they guarantee trouble-free seating of the blank cartridge device 25 on the muzzle despite the high tolerances, and because they prevent the device 25 from rattling and wobbling and, as a result, from shaking out and loosening.

Advantageously, the bushing 27 has passages 63 arranged, so that when the blank cartridge device is mounted, but not fastened, the propellant gases escaping through the slits 19 in the flash reducer 9 exit the device 25 via the passages 63. If it escapes the attention of the shooter that the blank cartridge device 25 is not attached and is, therefore, pushed forward by the compression spring 47, and the shooter then fires a blank cartridge, the blank cartridge device will not be flung forward like a rifle grenade. Instead, the propellant gases are diverted laterally through the passages 63. However, the blank cartridge device 25 will likely fall to the ground during such an event.

As discussed above, a seal 51 for gas-tight engagement with the coaxial, cylindrical opening 15 of the flash reducer 9 is advantageously arranged on the outside periphery of the free end of the end connector 35. In this fashion, erosion in the gap between the end connector 35 and the wall of the opening is prevented and, at the same time, precise seating of the blank cartridge device 25 is guaranteed.

Jamming of the flash reducer 9 by residues of penetrating propellant gases is also prevented by an axially extended sealing gap, since these gases do not penetrate into the gap because of the seal 51.

Although persons of ordinary skill in the art will appreciate that a soft plastic ring or the like could advantageously be used as seal 51, in the preferred embodiment, the seal 51 includes at least one piston ring-like sealing ring 51. This type of sealing ring 51 can consist of steel; hard and, optionally reinforced, plastic; or another piston ring material. The use of rigid piston ring material is advantageous because it prevents the rings from being pressed by pressure into a large gap between the end connector 35 and the wall of the hole. Larger, still admissible tolerances are therefore possible.

As already indicated above, the blank cartridge device could optionally be screwed onto either the flash reducer or onto the barrel. However, in the preferred embodiment, when the blank cartridge device 25 is pushed onto the flash reducer 9, its rear end extends over a shoulder or the rear end of the flash reducer 9 forming a shoulder and, a locking device 53 on the rear end of the blank cartridge device 25 engages behind the shoulder. The blank cartridge device 25 is, therefore, advantageously attached so that it can be emplaced with one movement. In embodiments employing the aforementioned compression spring 47, spring 47 ensures that, during mounting, the bushing 27 only remains in its locked position when locking has been effective.

Although persons of ordinary skill in the art will appreciate that the locking device 53 could optionally be implemented with radial claws that engage behind the shoulder of the flash reducer 9, preferably the locking device 53 is formed from a nonradial, transversely running blocking element. This blocking element is advantageous in that it can engage the shoulder over a larger angular range than could a radial element, so that a single such blocking element can be fully adequate to secure the device 25 to a firearm.

In the preferred embodiment, it is particularly advantageous that the blocking element is arranged for movement in a transverse groove of the blank cartridge device or its bushing, and that the blocking element has a structure that protrudes above the outer contour of the blank cartridge device 25 or its bushing 27, preferably on the top, when the blocking element is incompletely secured. The blocking element therefore forms a clearly visible indication as to whether the locking device 53 is closed or not. This visibility is particularly useful, for example, if the compression spring 47 should become ineffective because of soiling or the like, or if, perhaps after long use of the weapon in blank shooting, the blocking element were to loosen for any reason.

The blocking element is preferably designed as a detent 55 which is mounted to pivot on one end in the transverse groove. Preferably, the detent 55 is forced by means of a detent spring 59 into engagement with a mating surface within the groove. Also preferably, the blocking element is designed as a handle 61 that fully enters the transverse groove when the detent is fully secured.

Preferably, a small angular change in position of the detent 55 is sufficient in order to make the handle 61 visibly emerge from the transverse groove. The detent spring 49 prevents loosening of the detent 55 in response to inertial forces. Moreover, when the detent engages the mating surface, the handle 61 cannot be grasped from the outside with a finger or similar blunt object, so that inadvertent loosening of the detent is also ruled out, if the shooter, for example, is passing through brush.

To remove the blank cartridge device 25, the handle 61 can be pushed back, grasped from behind and lifted out of the transverse groove 57, perhaps by means of the tip of a pocketknife-corkscrew, against the action of the detent spring.

Although certain instantiations of the teachings of the invention have been described herein, the scope of coverage of this patent is not limited thereto. On the contrary, this patent covers all instantiations of the teachings of the invention fairly falling within the scope of the appended claims either literally or under the doctrine of equivalents.

What is claimed is:

1. For use with a fireman having a flash reducer, the firearm including a barrel having a front end and defining a barrel bore, the flash reducer defining a cylindrical bore disposed adjacent the front end of the barrel and further defining an expanding bore in communication with the cylindrical bore, the flash reducer including a gas outlet opening in a wall defining the expanding bore, a blank cartridge device comprising:

a bushing defining a bushing bore sized to receive the flash reducer, the bushing being longitudinally movable with respect to the flash reducer between a released position and a locked position;

a block mounted within the bushing bore, the block including an end connector defining a blind hole disposed in substantial alignment with the barrel bore; and a compression spring disposed within the bushing bore such that movement of the bushing from the released position to the locked position compresses the spring, the spring being sized to locate the bushing in the released position when the spring is uncompressed.

2. A blank cartridge device as defined in claim 1 wherein, when the bushing is in the released position, propellant gases exiting the barrel bore are exhausted through the gas outlet opening in the expanded bore of the flash reducer.

3. A blank cartridge device as defined in claim 2 wherein the bushing defines a passage for exhausting the gas passing through the gas outlet opening.

4. A blank cartridge device as defined in claim 1 wherein the bushing provides a visual indication that it is unsecured with respect to the firearm when the bushing is in the released position.

5. A blank cartridge device as defined in claim 1 wherein the compression spring is mounted around the end connector of the block.

6. A blank cartridge device as defined in claim 1 wherein the compression spring is mounted for compression between the block and the flash reducer.

7. A blank cartridge device as defined in claim 6 further comprising a stop ring disposed between the compression spring and a surface of the flash reducer.

8. A blank cartridge device as defined in claim 1 wherein the blind hole is narrowed with respect to the barrel bore.

9. A blank cartridge device as defined in claim 1 wherein the block has an outer surface cooperating with the bushing to define a non-linear gas outlet channel, the gas outlet channel communicating with the blind hole via an exhaust channel.

10. A blank cartridge device as defined in claim 9 wherein the non-linear channel is substantially coil-shaped.

11. A blank cartridge device as defined in claim 1 wherein the end connector is located within the cylindrical bore of the flash reducer when the bushing is in the locked position.

12. A blank cartridge device as defined in claim 11 further comprising a seal mounted on the end connector, the seal being disposed in sealing engagement with the cylindrical bore of the flash reducer when the bushing is in the locked position.

13. A blank cartridge device as defined in claim 12 wherein the seal comprises at least one sealing ring.

14. A blank cartridge device as defined in claim 1 further comprising a locking device mounted on the bushing, the locking device being adapted to engage behind a surface of the flash reducer to secure the bushing to the flash reducer when the bushing is in the locked position.

15. A blank cartridge device as defined in claim 14 wherein the locking device comprises a non-radial, transversely running blocking element.

16. A blank cartridge device as defined in claim 15 wherein the bushing defines a transverse groove, the blocking element being mounted within the groove for movement between a secured position and an unsecured position.

17. A blank cartridge device as defined in claim 16 wherein the blocking element includes an extension that protrudes from the bushing unless the blocking element is in the secured position.

18. A blank cartridge device as defined in claim 16 wherein the blocking element comprises:

a detent having a first end and a second end, the first end of the detent being pivotally mounted within the transverse groove, the second end of the detent being adapted to mate with a mating portion of the bushing when the blocking element is in the secured position; and a detent spring biasing the detent towards the mating portion of the bushing to ensure securement thereto when the blocking element is in the secured position.

19. A blank cartridge device as defined in claim 18 further comprising a handle extending from the detent, the handle protruding from the bushing unless the blocking element is in the secured position.

20. A blank cartridge device as defined in claim 1 wherein the bushing defines a first plug aperture, the block defines a second plug aperture, and further comprising a plug sized to be simultaneously disposed within the first and the second plug apertures to locate the block with respect to the bushing.

21. A blank cartridge device as defined in claim 20 wherein the first and second plug apertures are open ended such that the plug can be pushed completely therethrough to permit removal of the block from the bushing.

22. A blank cartridge device as defined in claim 1 wherein the blind hole includes a narrowed section, the narrowed section being disposed adjacent the expanding bore of the flash reducer when the bushing is disposed in the locked position such that, when a live round is discharged into the blind opening, the narrowed section deforms without damaging the flash reducer.

23. For use with a firearm having a flash reducer, the firearm including a barrel having a front end and defining a barrel bore, the flash reducer defining a cylindrical bore disposed adjacent the front end of the barrel and further defining an expanding bore in communication with the cylindrical bore, a blank cartridge device comprising:

a bushing defining a bushing bore sized to receive the flash reducer, the bushing being longitudinally movable with respect to the flash reducer between a released position and a locked position and defining a transverse groove;

a block mounted within the bushing bore, the block including an end connector defining a blind hole disposed in substantial alignment with the barrel bore; and a non-radial blocking element mounted within the transverse groove for movement between a secured position and a non-secured position, the blocking element being positioned to engage a surface of the flash reducer to secure the bushing to the flash reducer when the bushing is in the locked position and the blocking element is in the secured position.

24. A blank cartridge device as defined in claim 23 wherein the blocking element includes an extension that protrudes from the bushing unless the blocking element is in the secured position.

25. A blank cartridge device as defined in claim 23 wherein the blocking element comprises:

a detent having a first end and a second end, the first end of the detent being pivotally mounted within the transverse groove, the second end of the detent being adapted to mate with a mating portion of the bushing when the blocking element is in the secured position; and a detent spring biasing the detent towards the mating portion of the bushing to ensure securement thereto when the blocking element is in the secured position.

* * * * *